US009867521B2

(12) United States Patent
Albright

(10) Patent No.: US 9,867,521 B2
(45) **Date of Patent: *Jan. 16, 2018**

(54) IMPLEMENT WASHING APPARATUS AND METHOD

(71) Applicant: Victor Ha Albright, San Diego, CA (US)

(72) Inventor: Victor Ha Albright, San Diego, CA (US)

(73) Assignee: Victor Ha Albright, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/351,404

(22) Filed: Nov. 14, 2016

(65) Prior Publication Data

US 2017/0181602 A1 Jun. 29, 2017

Related U.S. Application Data

(63) Continuation of application No. 15/013,967, filed on Feb. 2, 2016, now Pat. No. 9,492,058, which is a continuation of application No. 14/088,005, filed on Nov. 22, 2013, now Pat. No. 9,247,860, which is a continuation of application No. 13/012,672, filed on Jan. 24, 2011, now Pat. No. 8,607,396.

(60) Provisional application No. 61/297,693, filed on Jan. 22, 2010.

(51) Int. Cl.
*A47L 17/02* (2006.01)
*A46B 15/00* (2006.01)

(52) U.S. Cl.
CPC ..... *A47L 17/02* (2013.01); *A46B 15/0055* (2013.01)

(58) Field of Classification Search
CPC ... A46B 11/00; A46B 2200/3033; A46B 9/00; A46B 200/03; A46B 2200/3073; A46B 11/001; A46B 11/0072; A46B 11/0062; A46B 15/0055; A47L 17/02; A47L 21/04
USPC .... 15/104.92, 159.1, 21.1, 38, 39, 222, 160, 15/218.1; 220/500, 507; 4/628, 638
See application file for complete search history.

(56) References Cited

U.S. PATENT DOCUMENTS 3,748,676 A * 7/1973 Warren ..... A63B 47/04 15/104.92
4,958,396 A * 9/1990 Butler ..... A63B 47/04 15/21.2
5,042,978 A * 8/1991 Quenin ..... A61B 10/0045 422/940
5,678,259 A * 10/1997 Cruz, Jr. ..... A47K 3/022 15/104.92
5,983,432 A * 11/1999 Jones ..... A63B 47/04 134/201
8,607,396 B2 * 12/2013 Albright ..... A47L 21/04 15/104.92
8,801,926 B2 * 8/2014 Housley ..... A47J 43/24 210/232
9,247,860 B2 * 2/2016 Albright ..... A47L 21/04
(Continued)

*Primary Examiner* — Marc Carlson
(74) *Attorney, Agent, or Firm* — Mintz Levin Cohn Ferris Glovsky and Popeo, P.C.

(57) ABSTRACT

An implement washing apparatus is disclosed. A portable, rigid housing defines at least a first basin and a second basin. The first basin has an open top and closed side walls and bottom for containing liquid to soak the implement. The second basin has side walls that include a plurality of bristles in an arrangement directed generally inwardly to a center of the second basin to scrub the implement.

6 Claims, 6 Drawing Sheets

(56) References Cited

U.S. PATENT DOCUMENTS

| | | | | |
|---|---|---|---|---|
| 9,492,058 | B2 * | 11/2016 | Albright | A47L 21/04 |
| 2005/0273957 | A1 * | 12/2005 | Boltryk | A46B 9/00 15/104.92 |
| 2006/0027469 | A1 * | 2/2006 | Irwin | A47L 13/51 206/216 |

* cited by examiner

IMPLEMENT WASHING APPARATUS AND METHOD

CROSS REFERENCE TO RELATED APPLICATION

This application is a continuation of U.S. patent application Ser. No. 15/013,967, entitled "IMPLEMENT WASHING APPARATUS AND METHOD," filed Feb. 2, 2016, that in turn is a continuation of U.S. patent application Ser. No. 14/088,005, entitled, "IMPLEMENT WASHING APPARATUS AND METHOD," filed Nov. 22, 2013, that in turn is a continuation of U.S. patent application Ser. No. 13/012,672, entitled, "IMPLEMENT WASHING APPARATUS AND METHOD," filed Jan. 24, 2011, that in turn claims the benefit under 35 U.S.C. §119(e) of the following provisional application, all of which is incorporated herein by reference in its entirety: U.S. Ser. No. 61/297,693, entitled "IMPLEMENT WASHING APPARATUS AND METHOD," filed Jan. 22, 2010.

BACKGROUND

Outside of using modern dishwashers, the most common technique used for washing implements such as utensils, cutting knives, or other tools or equipment, has been to hold the implement with one hand, and alternatively scrub the implement with a brush or sponge held by the other hand and rinse under running water from a faucet. In some cases, implements are allowed to soak first in a basin formed by a sink, a glass, or a bowl, to soften foodstuffs or dirt that sticks to the implements. Yet, even in these cases, the soaked implements must be scrubbed and washed using two hands as described above.

Further, when such basin is used, they are separate and removed from any scrubbing tool. The scrubbing tool may be set aside near the edge of a sink, in the sink, on the floor surrounding the sink, or in any of a number of locations removed from the basin. This separation leads to unnecessary difficulty and complexity in a process to wash implements, as well as requiring the user to use both hands during the washing process.

SUMMARY

This document presents an implement washing apparatus, and a method for using the same, in which the aforementioned problems are addressed to make an implement washing process economical, easy and efficient. Further, the implement washing apparatus provides a unitary device, which may also be modular, for keeping the two major functions of a washing process—soaking and scrubbing—in near proximity to each other.

In one aspect, an implement washing apparatus is made of a portable, rigid housing defining at least a first basin and a second basin, the first basin having an open top and closed side walls and bottom for containing liquid to soak the implement. The second basin has side walls that include a plurality of bristles in an arrangement directed generally inwardly to a center of the second basin to scrub the implement.

In other aspect, the implement washing apparatus can have further numbers of basins, of any size, and can be adapted to fit in a sink or over a bridge between two or more compartments of a sink.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes an implement washing apparatus, and a method for making and using an implement washing apparatus. In preferred exemplary implementations, an implement washing apparatus includes at least a first basin for soaking one or more implements, and at least a second basin, connected with or otherwise integrated with the first basin, for scrubbing the soaked one or more implements with a set of bristles that are connected with side walls of the second basin. The implement washing apparatus may include a bridge for being mounted on a subdividing wall of a multi-basin sink, for example, or may include one or more suction cups or friction-bearing feet on the bottom of the apparatus to fix the implement washing apparatus in a desired position.

In accordance with the preferred exemplary implementations, a user can place the one or more implements in the first basin, which can then be filled, or be pre-filled, with a cleaning fluid such as water or soap and water. The one or more implements can be left to soak in the first basin for a desired amount of time, to loosen any matter such as food, dirt or stains that is solidly stuck on the one or more implements. The user can then select at least one implement from the first basin and place that implement into the second basin to scrub the loosened material from the implement. The implement may be "dunked" repeatedly into the second basin, in order to guide the implement along some of the set of bristles, where the bristles forcibly remove the loosened but still-stuck on matter.

Figure 1A:
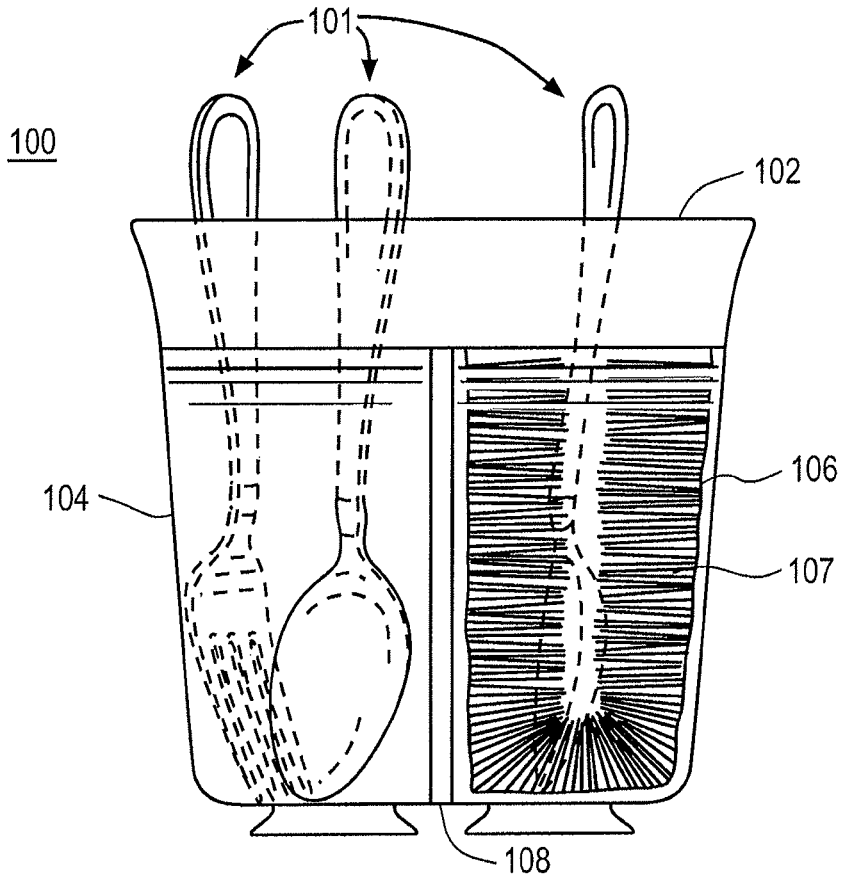
FIGS. 1A and 1B illustrate one variation of an implement washing apparatus.
Figure 1B:
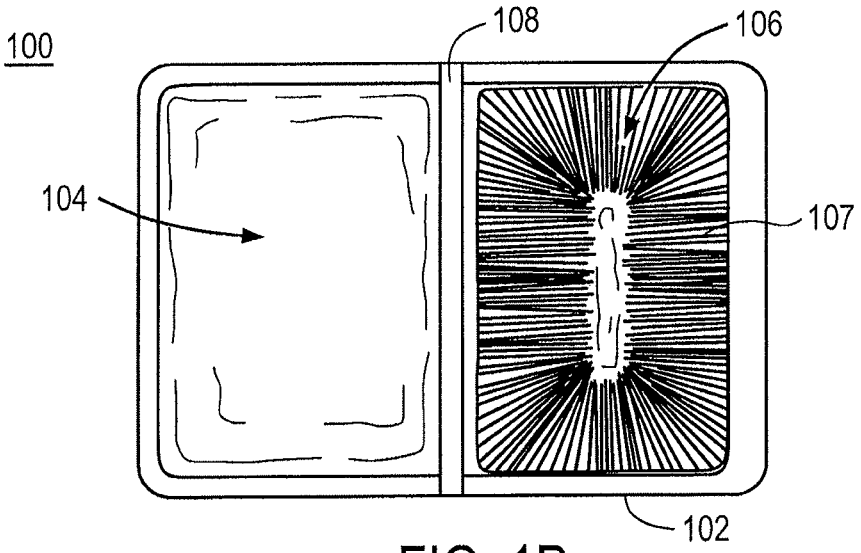

FIG. 1A is a side view and FIG. 1B is a top-down view of an implement washing apparatus 100 for soaking and scrubbing one or more implements 101. The implements include food utensils or other tools, such as knives, sticks, scissors, or any other implement that may be soiled with stuck-on matter such as food or dirt, which typically is not fully cleaned by even a dishwasher if available. The implement washing apparatus 100 includes a housing 102. The housing can be squared or rounded, and can include one or more side walls and a bottom. The one or more side walls and the bottom can be closed and impermeable to fluids such as water. Alternatively, selected areas of either the side walls and/or the bottom can be provided with one or more holes or channels to allow fluid and other matter to exit the housing.

The housing 102 may include, or defines, a first basin 104 and a second basin 106. More basins may also be defined in the housing. The first basin 104 includes closed side walls and a closed bottom, and is adapted and arranged to hold a liquid such as water or soap and water, to soak one or more implements 101. The second basin 106 includes side walls and a bottom. The side walls of the second basin 106 includes a number of bristles 107 that are attached to the side walls and which are generally directed inwardly to a central area of the second basin 106. In some variations, the bottom of the second basin 106 may also include bristles that extend upwardly. The bristles 107 may be part of, for example, a brush, or may be connected to a wire that circumscribes the inside of the side walls of the second basin 106.

The housing 102, and therefore the first and second basins 104, 106, may be formed of a water-proof, rigid material such as plastic, PVC, thermoplastic, nylon, acrylic, carbon fiber composite material, hardened rubber, stainless steel, aluminum, or other material. The bristles 107 can be formed of any material that is preferably non-abrasive, such as plastic, nylon, of any other non-abrasive yet flexibly rigid material. The housing 102 of the implement washing apparatus 100 can include one or more subdividing walls 108 that join and connect the first and second basins 104, 106. The subdividing wall 108 may form at least one of the side walls of the first and/or second basins 104, 106. The subdividing wall 108 may also be formed of a connection of side walls of the first and second basins 104, 106.

Figure 2B:
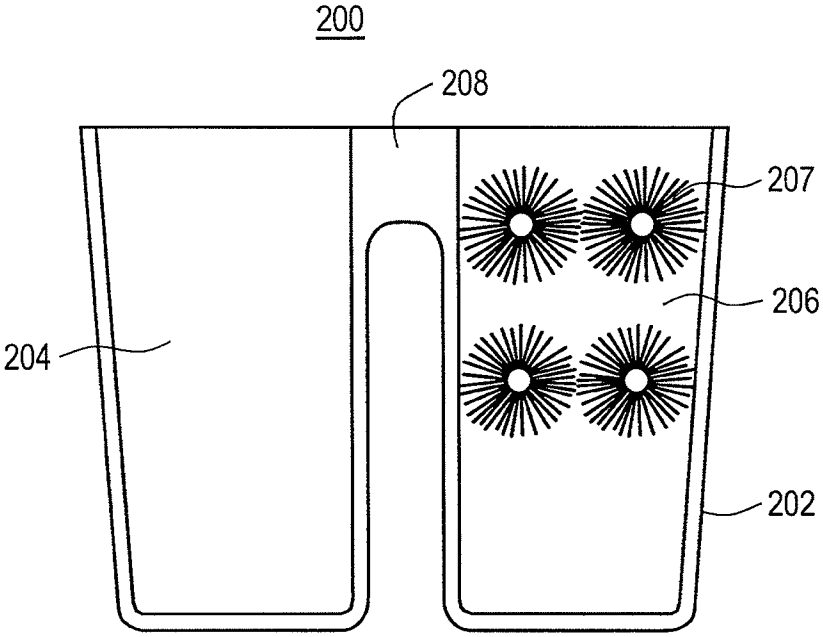
FIGS. 2A and 2B illustrate another variation of an implement washing apparatus.
Figure 2A:
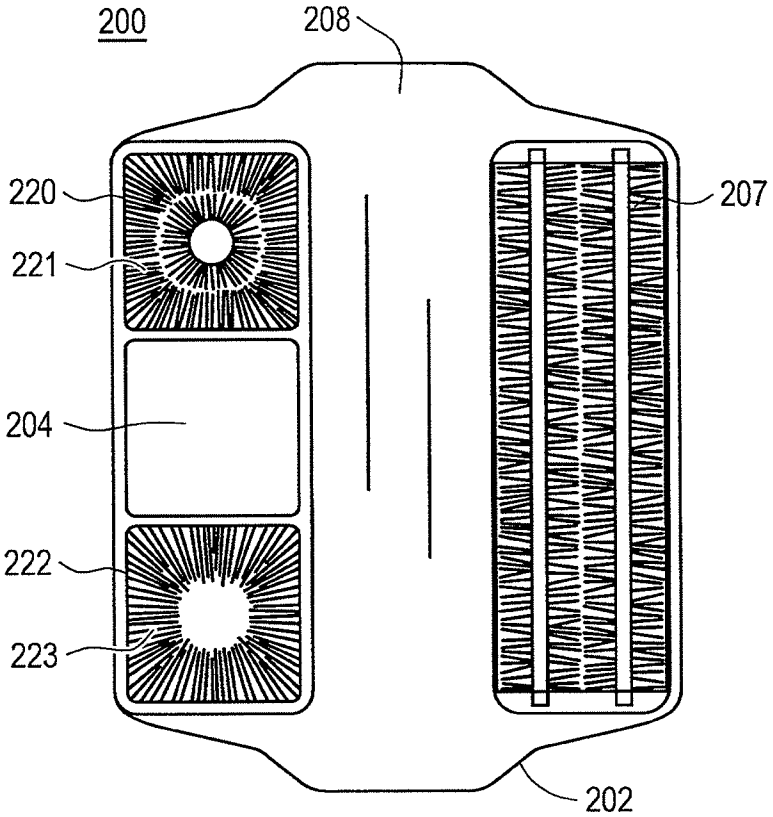

FIG. 2A shows a top-down view and FIG. 2B shows a side view of an alternative implement washing apparatus 200. The implement washing apparatus includes a first basin 204, a second basin 206, and may include a third basin 220 and fourth basin 222. The second basin 206 includes a set of bristles 207 adapted for scrubbing an implement. The bristles 207 are shown as extending radially from a rotor that is connected on opposite ends to opposing side walls of the second basin 206. In this arrangement, the second basin 206 can be used to wash and scrub generally planar or wide implements such as plates, bowls, or a number of different implements simultaneously. Each of the basins in the implement washing apparatus 200 may be adapted to hold fluid such as water or soap.

As shown in FIG. 2A, the third basin 220 includes bristles 221, which may include a first set of bristles that are generally directed inwardly, while a second set of bristles are attached to, and radiating outwardly from, an upward-extending protrusion. In this arrangement, implements such as bowls, cups, glasses or mugs may be scrubbed by the bristles 221. The fourth basin 222 may include inwardly directed bristles 223 that are attached to at least some side walls of the fourth basin.

The implement washing apparatus 200 may further include one or more bridges 208. Each bridge 208 is adapted to connect at least two basins together, as well as provide a downward facing arch for placement on a subdividing wall of a multi-basin sink, for example. The bridge 208 and basins may all be formed from one unitary material that makes up housing for the implement washing apparatus 200.

Figure 3:
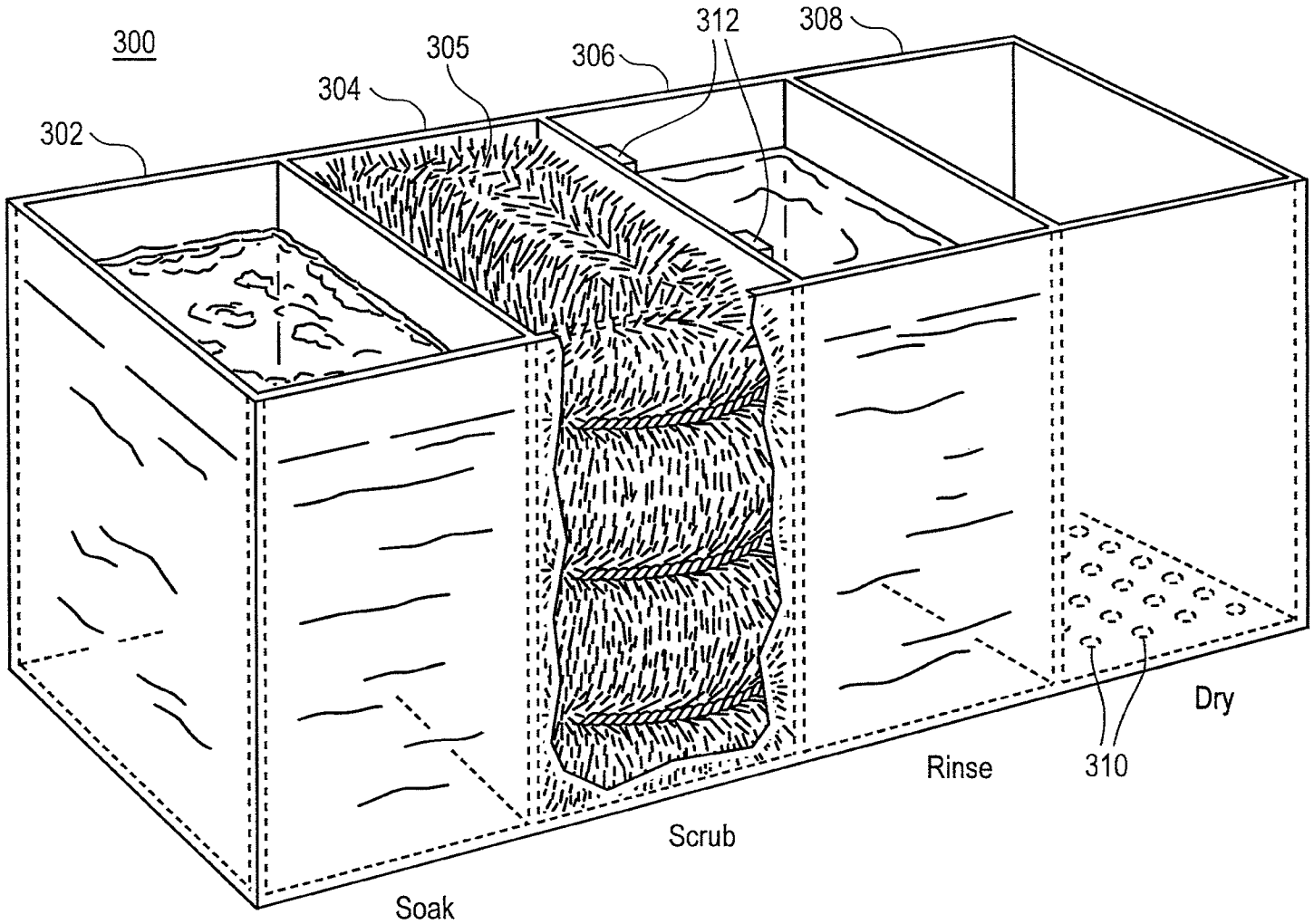
FIG. 3 is a perspective view of yet another variation of an implement washing apparatus.
Figure 4:
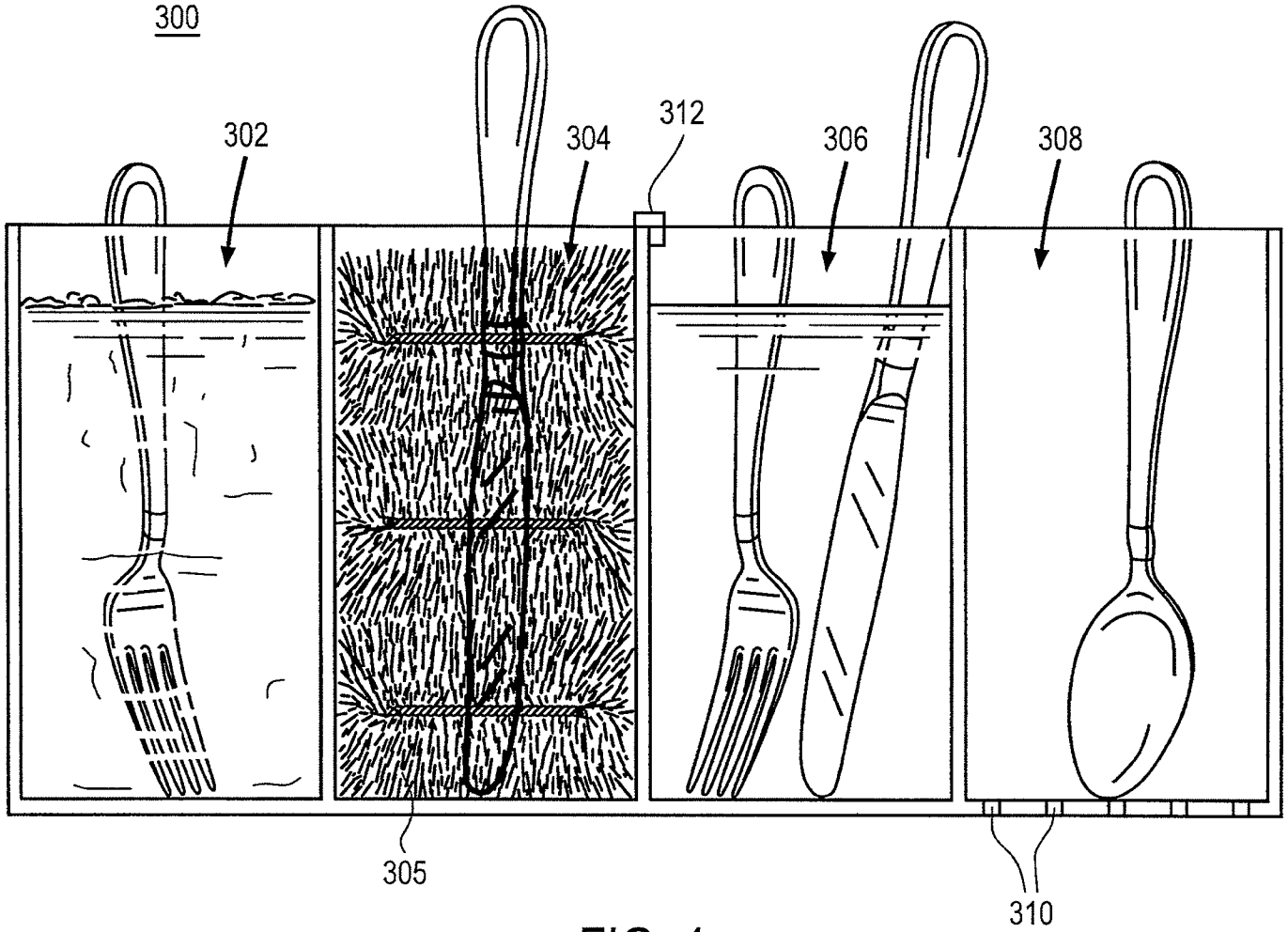
FIG. 4 is a side view of the implement washing apparatus shown in FIG. 3.

FIG. 3 is a perspective view and FIG. 4 is a side view an implement washing apparatus 300 in accordance with yet another variation. The implement washing apparatus 300 includes a soak basin 302, a scrub basin 304, a rinse basin 306, and a dry basin 308. These basins of the implement washing apparatus 300 can be used sequentially to soak, scrub, rinse and then dry an implement such as a fork, knife, spoon, or other implement.

The soak basin 302, scrub basin 304, and rinse basin 306 are preferably completely closed except for a top opening, to be able to hold water or other liquid. For instance, the soak basin 302 is adapted for holding warm water with soap that soaks an implement and any matter stuck thereon. The scrub basin 304 can also hold water or other liquid, but also includes bristles 305 or other scrubbing members which allow an implement to be inserted therein and scrubbed against them. The rinse basin 306 preferably holds just water to rinse off any remaining matter or soap suds. The dry basin 308 includes a number of holes 310 on a bottom surface to allow draining of any water, liquid or other matter therethrough. Implements can therefore be placed in the dry basin 308 where they will dry automatically and without further user manipulation.

Two or more of the basins 302, 304, 306 and 308 may be connected together by connectors 312. For instance, a subunit can include two basins, and two subunits can be connected together by connectors 312 to form the implement washing apparatus 300. Alternatively, a subunit can include one basin, and two or more basins can be connected together to form the implement washing apparatus 300. Accordingly, an implement washing apparatus 300 may have one to any number of basins. In some implementations, each basin can be provided in a common form, i.e. with holes 310 and receptacles for holding bristles 305 or other scrubbing members, and the user can configure the common form to hold water by way of a bottom cover that can be placed at the bottom of the basin to cover the holes. In this way, each basin can be made from the common faun and tailored with accessories based on user needs or preferences. Further, the number of basins used by a user and connected together can be tailored for the environment or sink size, etc.

Figure 5A:
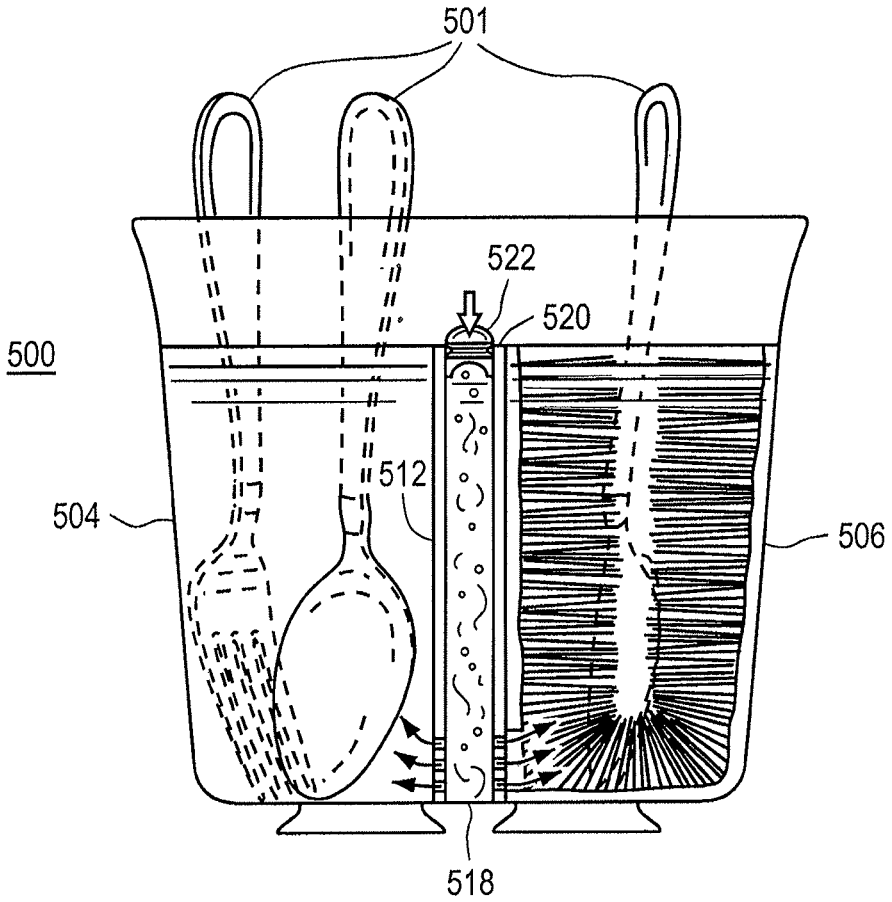
FIGS. 5A and 5B illustrate another variation of an implement washing apparatus.
Figure 5B:
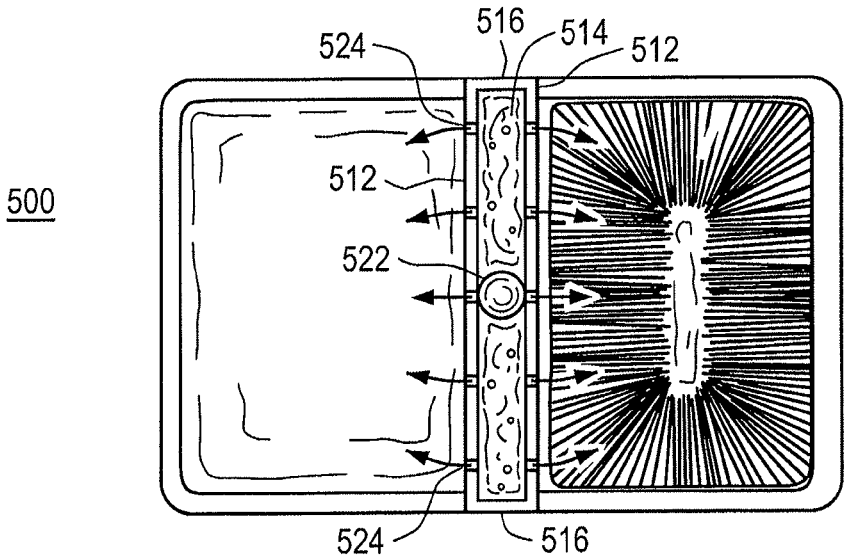

FIG. 5A is a side view and FIG. 5B is a top-down view of an implement washing apparatus 500 for soaking and scrubbing one or more implements 501, similar to the implementation shown in FIGS. 1A and 1B. However, instead of a subdividing wall between a first basin 504 and a second basin 506, the implement washing apparatus 500 includes a soap basin 510 that is enclosed by opposing side walls 512, top wall 514, opposing end walls 516 and bottom wall 518. In this arrangement, the soap basin 510 forms substantially a hollow rectangular basin, although in other arrangements the soap basin 510 can be rounded, curvilinear or multi-angular.

The top wall 514 includes an inlet 520 that is closeable by a rubber pump stop 522. The rubber pump stop 522 is compressible, to subject the inner cavity of the soap basin 510 to additional pressure. At least one of the opposing side walls 516 includes a set of holes 524 that are sized to inhibit flow of liquid soap therethrough unless the rubber pump stop 522 is compressed and additional pressure is exerted to the inner cavity of the soap basin 510. Since liquid soap generally has a higher viscosity than water in the first and/or second basins 504 and 506, the holes 524 are small, and can range from 0.01 to 10 millimeters. The size of the hole is adapted to and consistent with the viscosity of the liquid soap being held in the soap basin 510. The holes 524 are preferably spaced apart at equal increments along the bottom of the side wall(s) 512 of the soap basin 510, to enable dispensing of the liquid soap into the first and/or second basins 504, 506 (illustrated by thin arrows in FIGS. 5A and 5B) upon compression of the rubber pump stop 522, as indicated by the thick arrow in FIG. 5A.

Figure 6:
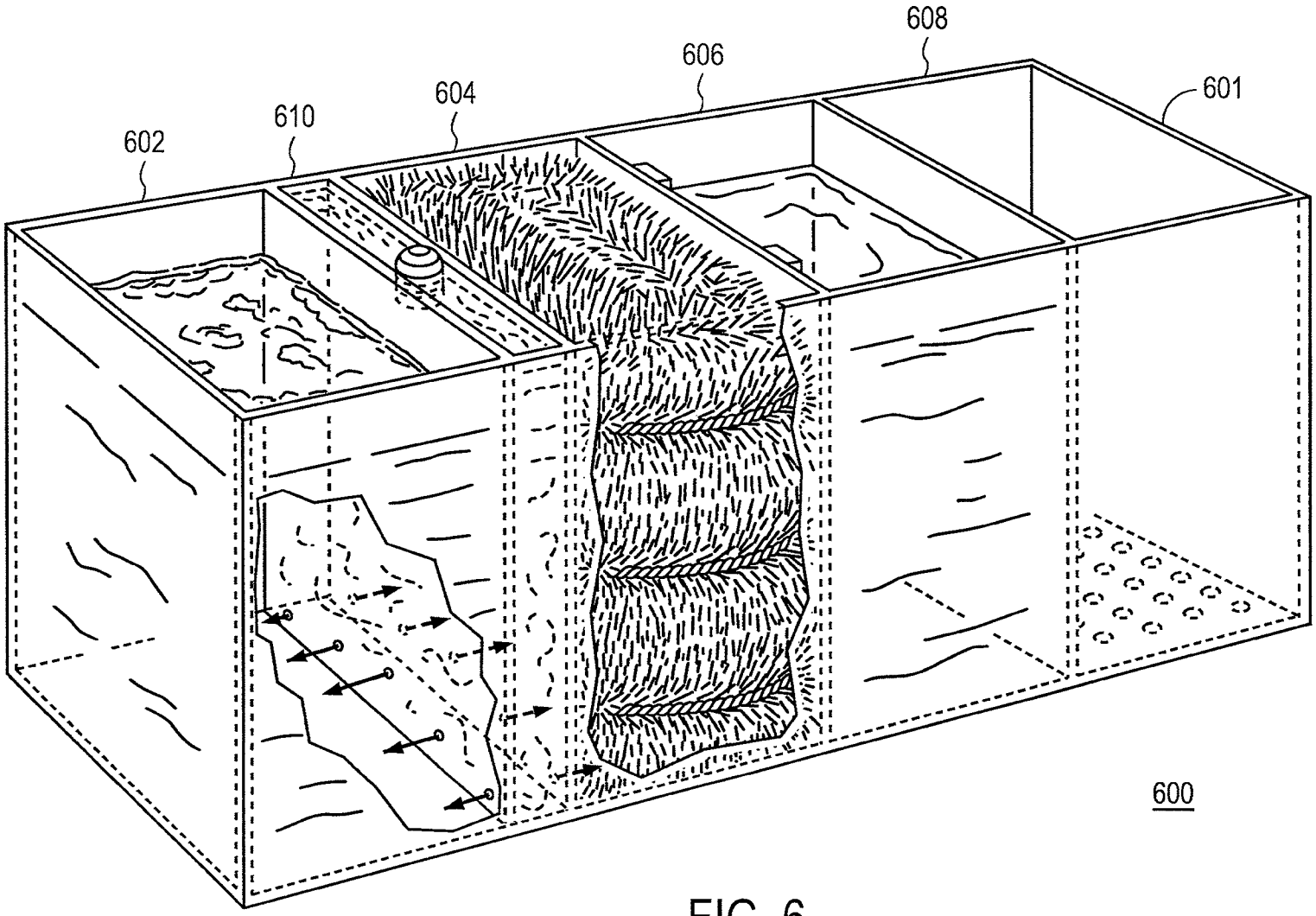
FIG. 6 is a perspective view of yet another variation of an implement washing apparatus.

FIG. 6 is a perspective view of yet another variation of an implement washing apparatus 600, which is similar to the apparatus 300 shown in FIG. 3, except apparatus 600 includes a soap basin 610 between at least two basins (602, 604) of the two or more basins (602, 604, 606, 608). The soap basin 610 is arranged and operates similarly to the basin 510 described above. Further, soap basin 610 can be connected to remote basins by soap dispensing channels arranged along the side or bottom, or within the housing 601 of the implement washing apparatus 600. The channels can have a cross-sectional area that is substantially the same as any holes that dispense liquid soap from the soap basin 610 to any other basin. Alternatively, other pairs of basins may be separated by a separate soap basin, to provide the implement washing apparatus 600 with two or more soap basins.

The above-described implement washing apparatuses can be used by a user for one-handed washing of implements, using waterproof, inexpensive and resilient basins. The implement washing apparatuses can also save significant amounts of water during the implement washing process, as the rinse cycle can be metered by water in the rinse basin, and food from the implements is easier to rinse off. Those having skill the art would recognize that the arrangements illustrated herein, especially the number and arrangement of basins within the apparatuses, are not limited to the specific number and arrangement as described herein. Although a few embodiments have been described in detail above, other modifications are possible. Other embodiments may be within the scope of the following claims.

What is claimed:

1. An implement washing apparatus comprising: a housing defining at least a first basin, a second basin, and a third basin, the first basin having an open top, and a closed body for containing liquid to soak the implement, the second basin having at least one side wall having a first plurality of bristles directed generally inwardly to a center of the second basin to scrub the implement, and the third basin having at least one side wall connected with a rotating member at least partially within the third basin, the rotating member having a second plurality of bristles extending radially therefrom; and a bridge connecting the first basin with the second basin, the bridge having a downward facing arch proximate the open top of the first basin for placement on a subdividing wall of a sink, the bridge further having two bridge walls extending down from the downward facing arch, one of the two bridge walls defining a portion of the closed body of the first basin, the other of the two bridge walls defining a portion of the at least one side wall of the second basin.

2. The implement washing apparatus in accordance with claim 1, wherein at least one of the first and second plurality of bristles are formed of a rigid, non-abrasive material.

3. The implement washing apparatus in accordance with claim 1, wherein the housing is formed of a water-resistant, resilient material from a group of water-resistant, resilient materials that consists of: plastic, thermoplastic, acrylic, stainless steel, aluminum, carbon fiber, and rubber.

4. An implement washing apparatus comprising: a first basin having an open top and a closed body, the first basin for containing liquid to soak the implement; a second basin connected with the first basin via the closed body, the second basin having at least one side wall having a first plurality of bristles directed generally inwardly to a center of the second basin to scrub the implement; a bridge connecting the first basin with the second basin, the bridge having a downward facing arch proximate the open top of the first basin, the bridge further having two bridge walls extending down from the downward facing arch, one of the two bridge walls defining a portion of the closed body of the first basin, the other of the two bridge walls defining a portion of the at least one side wall of the second basin; and a third basin connected with the first or second basin and having placed therein a second plurality of bristles extending radially from a rotating member connected to at least one sidewall of the third basin, the second plurality of bristles being softer than the first plurality of bristles.

5. The implement washing apparatus in accordance with claim 4, wherein at least one of the first and second plurality of bristles are formed of a rigid, non-abrasive material.

6. The implement washing apparatus in accordance with claim 4, wherein the first and second basins are formed of a water-resistant, resilient material from a group of water-resistant, resilient materials that consists of: plastic, thermoplastic, acrylic, stainless steel, aluminum, carbon fiber, and rubber.

* * * * *